US007371115B1

(12) United States Patent
Hsieh et al.

(10) Patent No.: US 7,371,115 B1
(45) Date of Patent: May 13, 2008

(54) MAT SEAL DEVICE

(75) Inventors: Shao C. Hsieh, Warren, OH (US); Michael Bashkin, Aurora, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/639,836

(22) Filed: Dec. 15, 2006

(51) Int. Cl.
*H01R 13/40* (2006.01)

(52) U.S. Cl. ..... 439/587; 439/271

(58) Field of Classification Search ..... 439/271–275, 439/587–589

See application file for complete search history.

(56) References Cited

U.S. PATENT DOCUMENTS 5,145,410 A * 9/1992 Maejima et al. ..... 439/587
5,766,039 A 6/1998 Abe
6,095,860 A * 8/2000 Gehrke et al. ..... 439/587
6,116,938 A * 9/2000 Myer et al. ..... 439/271
6,217,394 B1 4/2001 Sugie

* cited by examiner

*Primary Examiner*—Briggitte R. Hammond
(74) *Attorney, Agent, or Firm*—David P. Wood

(57) ABSTRACT

A mat seal device for preventing water from entering an electrical connector through an opening provided for cables to be inserted into the connector. The device includes an elastic mat that plugs an opening in the connector. A peripheral edge seal of the mat seals between the mat and an inner surface of the connector housing. Cable insertion holes receive cables into the connector and prevent moisture from passing through the holes around the cables received in those holes. Each cable insertion hole includes annular sealing ribs that elastically enlarge when receiving a cable and seal against an outer surface of the cable. Recesses formed in front and back surfaces of the mat adjacent the cable insertion holes relieve expansion of the sealing ribs.

18 Claims, 3 Drawing Sheets

MAT SEAL DEVICE

BACKGROUND OF THE INVENTION

This invention relates generally to a mat seal device for preventing water from entering an electrical connector through an opening provided for cables to be inserted into the connector.

Mat seals are devices used to prevent water from entering an electrical connector through an opening provided for cables to be inserted into the connector. A mat seal includes a mat of elastic material shaped to fit within and across a correspondingly-shaped opening in one end of an electrical connector housing. An outer peripheral edge seal prevents moisture from passing between an outer periphery of the mat and an inner sealing surface of the connector housing. Cables bearing crimp-style terminals are inserted through cable-sealing cable insertion holes formed in the mat and into terminal locations or "terminal cavities" within the connector housing. The cable insertion holes prevent moisture from passing between an inner periphery of each cable insertion hole and an outer surface of the cable that extends through that hole.

For example, U.S. Pat. No. 5,766,039 issued 16 Jun. 1998 to Abe, discloses such a mat seal device with slits extending through a thickness of the mat from the outer peripheral edge seal of the mat through to each cable-sealing insertion hole to provide a relief for easing insertion of a terminal and cable through each hole. However, to seal the slits a plurality of pressing holes or recesses must be formed in an outer-facing surface of the mat adjacent the cable insertion holes, and a special cover must be fabricated to include corresponding tapered projections that are received into the pressing holes when the cover is snapped into place over an opening in a connector housing into which the mat seal has been received. The cover presses the tapered projections into the pressing holes which forces the pressing holes to enlarge diametrically and elastically deforms portions of the mat surrounding the holes causing the slits to close and seal.

Also, U.S. Pat. No. 6,217,394B1 issued 17 Apr. 2001 to Sugie, discloses a mat seal comprising a plurality of cable-sealing cable insertion holes that each include a corrugated seal portion, i.e., two axially-spaced, radially inwardly-extending integral annular sealing ribs. Each sealing rib has an aperture diameter less than a diameter of a cable to be received in the hole so that each sealing rib will be elastically enlarged when receiving the cable and will constrict around and seal against an outer surface of the cable. But a mat seal device constructed according to the Sugie patent is unable to accommodate terminals of varying configurations and cables of varying diameters without cutting, pinching, or otherwise damaging or distorting the sealing ribs within the cable insertion holes or distorting the mat such that terminals, as they are being inserted, fail to coaxially align with terminal cavities in the connector.

It would be desirable for a mat seal to be able to seal an opening in a connector housing without the aid of specially-designed cover and without breaks along the peripheral edge seal, and without any apertures, other than the insertion holes, that pass completely through the thickness of the mat. It would also be desirable for a mat seal to be able to accommodate terminals of varying configurations and cables of varying diameters without cutting, pinching, or otherwise damaging or distorting the sealing ribs within the cable insertion holes or distorting the mat such that terminals, as they are being inserted, fail to coaxially align with terminal cavities in the connector.

SUMMARY OF THE INVENTION

A mat seal device is provided for preventing water from entering an electrical connector through an opening provided for cables to be inserted into the connector. The device includes a mat of elastic material shaped to fit within and across a correspondingly-shaped opening in one end of an electrical connector housing to prevent moisture from entering the housing through the opening and an outer peripheral edge seal configured to prevent moisture from passing between an outer periphery of the mat and a corresponding inner sealing surface of a connector housing. The device also includes a cable-sealing cable insertion hole that is configured to receive insertion of a cable into a connector and to prevent moisture from passing between an inner periphery of the cable insertion hole and an outer surface of a cable received in that hole. The cable insertion hole includes a radially inwardly-extending annular sealing rib having an aperture smaller in diameter than a cable to be received in the hole so that the first annular sealing rib will be elastically enlarged when receiving the cable and will constrict around and seal against an outer surface of the cable.

Unlike the prior art of record, the mat seal device may also include a recess formed in a surface of the mat adjacent and spaced from the cable insertion hole and configured to relieve expansion of the adjacent annular sealing rib so that a metal terminal can be pushed through the cable insertion hole into a connector cavity without cutting or pinching the annular sealing rib within the cable insertion hole and to allow the mat seal device to accommodate a larger range of cable sizes by increasing the expansion capability of the cable insertion hole. Therefore, a mat seal device constructed according to the invention is able to seal an opening in a connector housing without the aid of specially-designed cover and without breaks along the peripheral edge seal, and without any apertures, other than the insertion holes, that pass completely through the thickness of the mat. A mat seal device constructed according to the invention is also able to accommodate terminals of varying configurations and cables of varying diameters without cutting, pinching, or otherwise damaging or distorting the sealing ribs and without distorting the mat such that terminals, as they are being inserted, fail to coaxially align with terminal cavities in the connector.

BRIEF DESCRIPTION OF THE DRAWINGS

These and other features and advantages will become apparent to those skilled in the art in connection with the following detailed description and drawings of one or more embodiments of the invention, in which.

DETAILED DESCRIPTION OF THE PREFERRED EMBODIMENTS

Figure 2:
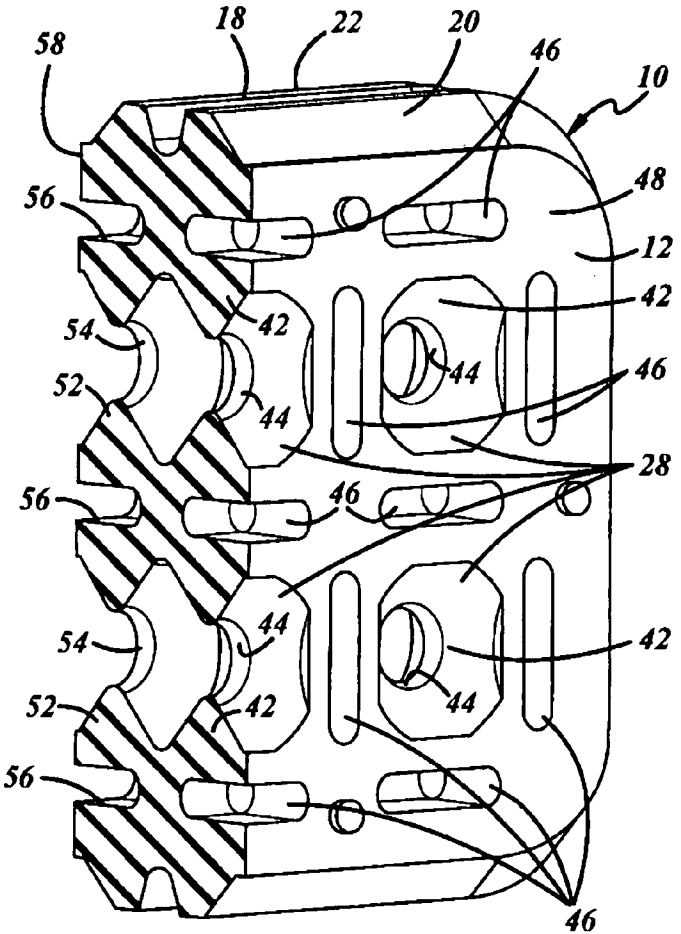
FIG. 2 is an orthogonal cross sectional view of the mat seal device of FIG. 1 taken along line 2-2 of FIG. 1.
Figure 1:
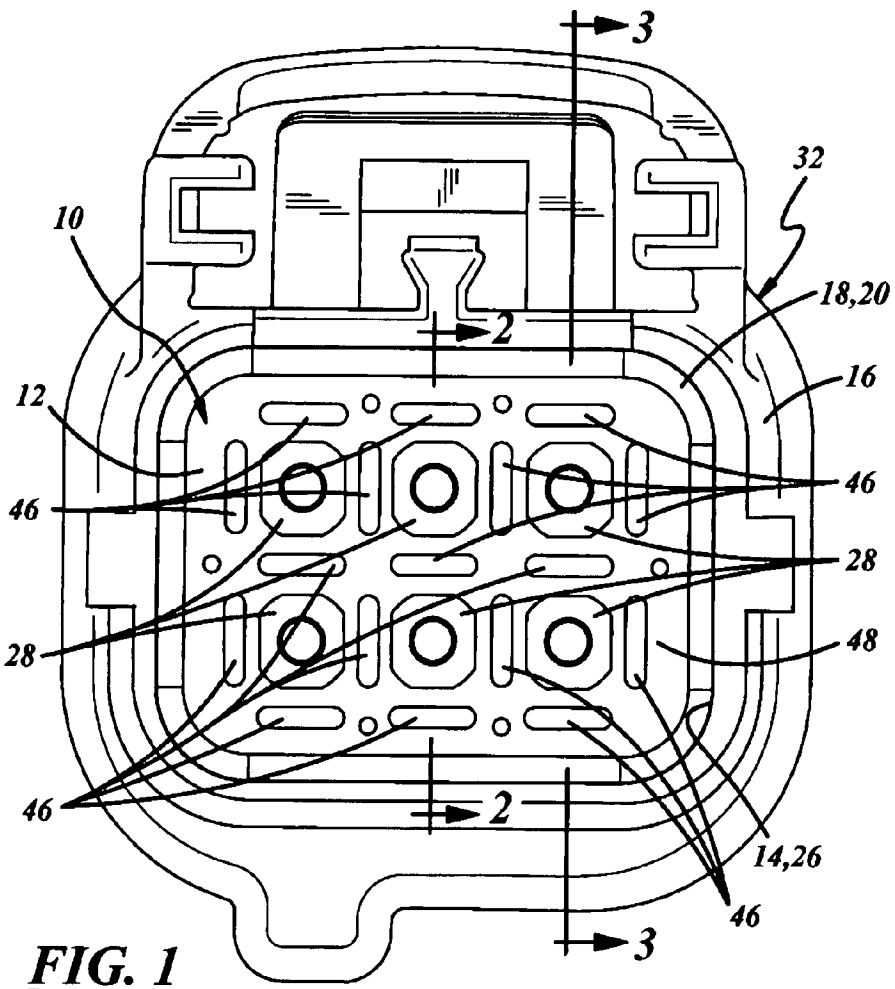
FIG. 1 is a front view of a connector including a mat seal device received into an opening in the connector with a cover of the connector removed for clarity.

A mat seal device 10 for preventing water from entering an electrical connector through an opening provided for cables to be inserted into the connector is generally shown at 10 in FIGS. 1-4. The device 10 may include a mat 12 of elastic material shaped to fit within and across a corresponding-shaped opening 14 at one end of an electrical connector housing 16 to prevent moisture from entering the housing 16 through the opening 14.

The mat 12 includes an outer peripheral edge seal 18 that includes forward and aft parallel, axially-spaced peripheral edge sealing ribs 20, 22. The peripheral edge sealing ribs 20, 22 prevent moisture from passing between an outer periphery of the mat 12 and a corresponding inner sealing surface 26 of a connector housing 16. Each of the peripheral sealing ribs 20, 22 extends integrally edgewise outward from around the mat 12 so that the peripheral sealing ribs 20, 22 will be elastically compressed when the mat 12 is received into a connector housing opening 14 and will seal against the inner surface 26 of the connector housing 16 into which the mat seal device 10 has been received.

Figure 3:
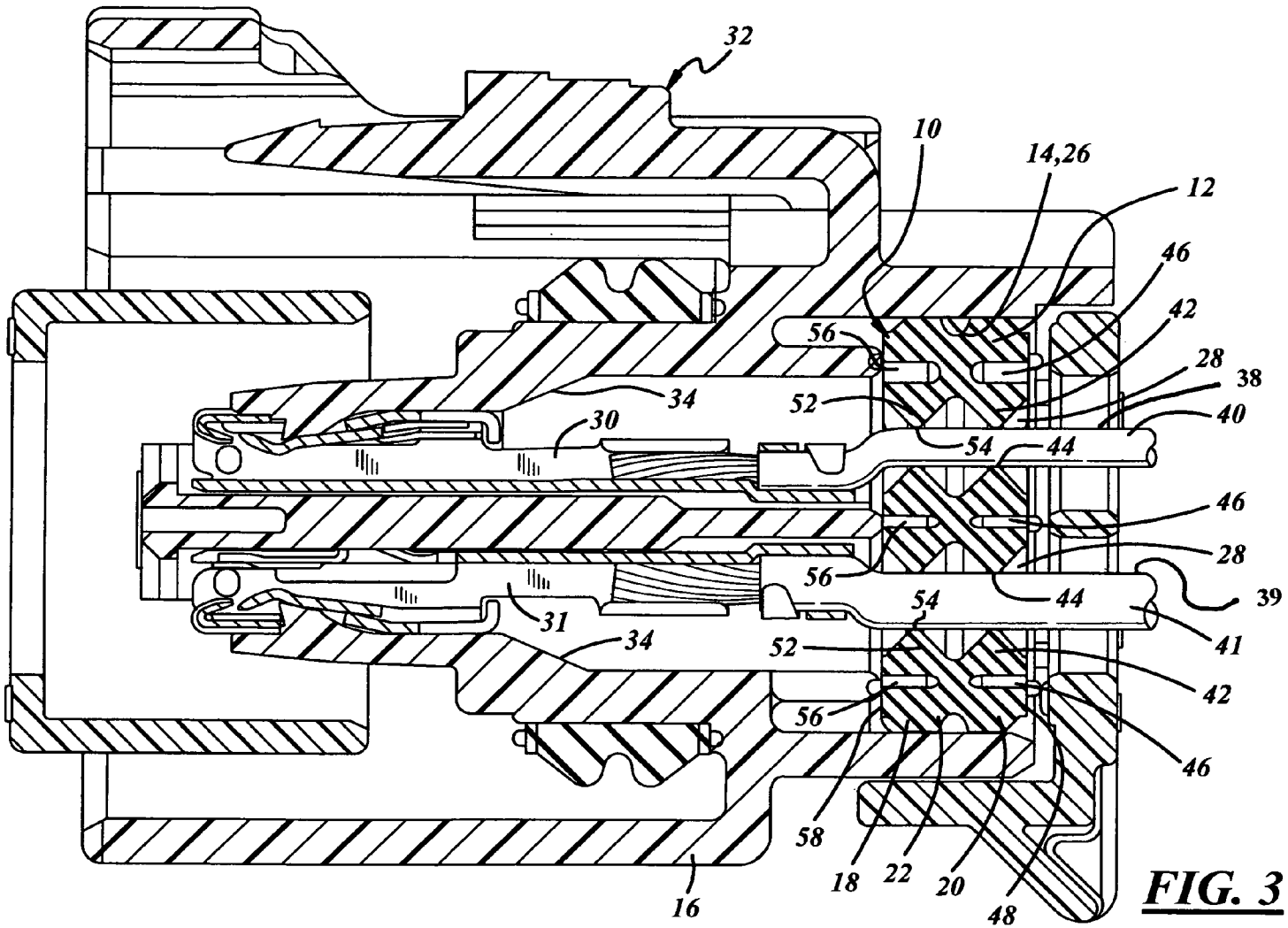
FIG. 3 is a cross-sectional side view of the connector of FIG. 1 taken along line 3-3 of FIG. 1 and showing two crimp-style terminals affixed to cables of differing diameters with the terminals mechanically retained and electrically connected within the connector and the cables received in cable-sealing cable insertion holes of the mat seal device.
Figure 4:
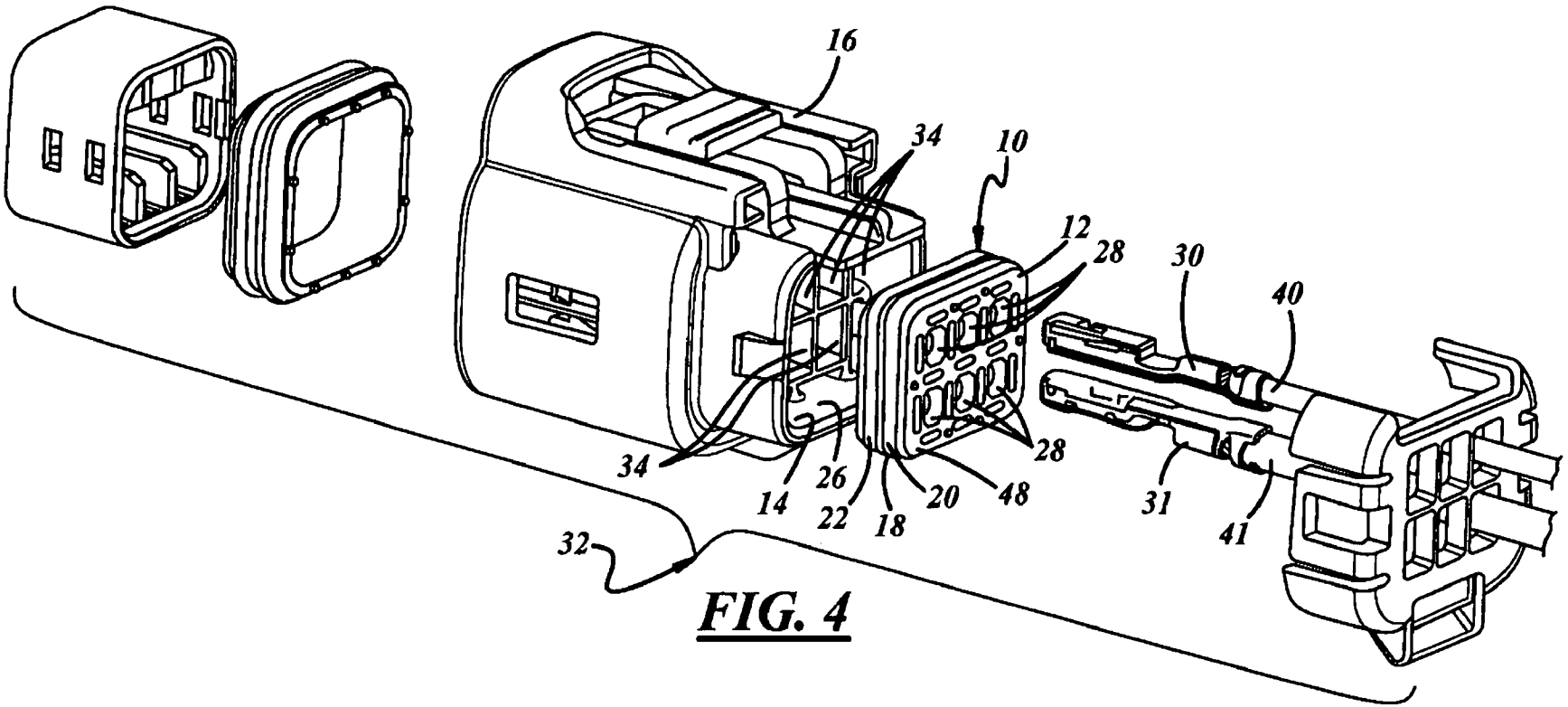
FIG. 4 is a perspective exploded view of the connector of FIG. 1.

The device 10 may also include a plurality of cable-sealing cable insertion holes 28. The cable insertion holes 28 each receive insertion of a cable 40, 41 that may bear a crimp-style terminal 30, 31 into a connector 32 in coaxial alignment with terminal cavities 34 within the connector 32 as shown in FIGS. 3 and 4. Each cable insertion hole 28 may be shaped to prevent moisture from passing between an inner periphery of each cable insertion hole 28 and an outer surface of a cable 40, 41 received in that hole 28.

As best shown in FIGS. 2 and 3, each cable insertion hole 28 includes a forward annular sealing rib 42 that extends radially and integrally inwardly from around a major diameter of each hole 28. Each forward annular sealing rib 42 includes a circular aperture 44 that is smaller in diameter than cables 40, 41 likely to be received in each of the cable insertion holes 28, respectively. Because its diameter is smaller than that of any cable 40, 41 that is likely to be received, each of the forward annular sealing ribs 42 will be elastically enlarged when receiving such a cable 40, 41 and will constrict around and seal against the outer surface 38, 39 of the cable 40, 41 as shown in FIG. 3.

The mat 12 may also include non-penetrating front-side relief slots or recesses 46 formed in a front surface 48 of the mat 12 adjacent and spaced from each cable insertion hole 28. As best shown in FIG. 3, each such front-side recess 46 may extend to a depth approximating that of the forward annular sealing rib 42 but without penetrating the mat 12. The front-side recesses 46 are positioned and shaped to relieve or absorb and ease expansion of the adjacent forward annular sealing rib 42 of each cable insertion hole 28 as again shown in FIG. 3. This allows metal terminals 30, 31 of varying cross-sectional sizes and shapes to be pushed through the cable insertion holes 28 into a connector cavity 34 without cutting or pinching the forward annular sealing rib 42 within each cable insertion hole 28. It also allows the mat seal device 10 to accommodate cables 40, 41 having a large range of sizes by increasing the expansion capability of the cable insertion holes 28.

More specifically with regard to the arrangement of the front-side recesses 46, four of the front-side recesses 46 may be formed in the front surface 48 of the mat 12 and disposed in an array surrounding each adjacent cable insertion hole 28. Each front-side recess 46 may be elongated in shape with rounded ends. The four front-side recesses 46 surrounding each hole 28 may be disposed in a generally symmetrical array equidistant from each cable insertion hole 28. This arrangement provides uniform relief allowing each hole 28 to expand uniformly and without being moved off-center to where terminals 30, 31 might become misaligned with terminal cavities 34 within a connector 32. Two of the four front-side recesses 46 surrounding each hole 28 may be disposed in diametrically opposite positions above and below each cable insertion hole 28 while the remaining two front-side recesses 46 may be disposed in diametrically opposite positions on either side of each cable insertion hole 28 and oriented perpendicular to the recesses positioned above and below each cable insertion hole 28.

As shown in FIGS. 2 and 3, each cable insertion hole 28 also includes an aft inwardly-extending annular sealing rib 52. As with the forward inwardly-extending annular sealing ribs 42, each aft annular sealing rib 52 includes a circular aperture 54 smaller in diameter than a cable 40, 41 to be received in each hole 28 so that each of the aft annular sealing ribs 52 will be elastically enlarged when receiving a cable 40, 41 and will constrict around and seal against an outer surface 38, 39 of each cable 40, 41 as shown in FIG. 3. In other words, the forward and aft annular sealing ribs 42, 52 of each cable insertion hole 28 form an annular corrugated seal within each hole 28.

As shown in FIGS. 2 and 3, mirroring the arrays of front-side recesses 46 on the front surface 48 of the mat 12, are arrays of back-side recesses 56 formed in a back surface 58 of the mat 12 opposite the front surface 48. As with the front-side recesses 46, four of the back-side recesses 56 are disposed in an array surrounding and adjacent each cable insertion hole 28. Each back-side recess 56 extends to a depth approximating that of the aft annular sealing rib 52 of the cable insertion hole 28 to which it is adjacent. As with the front-side recesses 46, this arrangement of back-side recesses 56 radially aligns the back-side recesses 56 with the expansion of the aft annular sealing ribs 52 as shown in FIG. 3. The back-side recesses 56 are disposed in generally symmetrical arrays equidistant from each of the cable insertion holes 28 to provide uniform relief allowing the holes 28 to expand uniformly and without being moved off-center to where terminals 30 might become misaligned with terminal cavities 34 within a connector 32. As with the front-side recesses 46, two back-side recesses 56 of each array of four are disposed in diametrically opposite positions above and below each of the cable insertion holes 28 while the remaining two back-side recesses 56 are disposed in diametrically opposite positions on either side of each of the cable insertion holes 28 in the back surface of the mat 12 and are oriented perpendicular to the recesses positioned above and below each cable insertion hole 28.

In the embodiment shown in the drawings, there are six cable insertion holes 28 arranged in a rectangular array. Obviously, in other embodiments there may be any number of cable insertion holes 28 arranged in any suitable array. As shown in the drawings, it may be that only a single recess 46, 56 is formed between laterally or vertically adjacent cable insertion holes 28 in the front and back surfaces of the mat 12. In other words, intervening recesses may be shared by adjacent holes 28 to allow the holes to be grouped closer together. Each such intervening recess relieves the expansion of cable insertion holes 28 on both sides of each recess.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A mat seal device for preventing water from entering an electrical connector through holes provided for cables to be inserted into the connector, the device comprising:

a mat of elastic material shaped to fit within and across a correspondingly-shaped opening in one end of an electrical connector housing and configured to prevent moisture from entering the housing through the opening;

an outer peripheral edge seal extending from the mat and configured to prevent moisture from passing between an outer periphery of the mat and a corresponding inner sealing surface of a connector housing;

a cable-sealing cable insertion hole extending through the mat and configured to receive insertion of a cable into a connector and to prevent moisture from passing between an inner periphery of the cable insertion hole and an outer surface of a cable received in that hole, the cable insertion hole including a first radially inwardly-extending annular sealing rib having an aperture smaller in diameter than a cable to be received in the hole so that the first annular sealing rib will be elastically enlarged when receiving the cable and will constrict around and seal against an outer surface of the cable; and a plurality of front-side recesses formed in a front surface of the mat adjacent and spaced from the cable insertion hole and configured to relieve expansion of the adjacent annular seating rib wherein the plurality of front-side recesses are disposed in an array of disconnected front-side recesses surrounding and adjacent the cable insertion hole.

2. A mat seal device as defined in claim 1 in which the outer peripheral edge seal includes two axially-spaced parallel peripheral seating ribs integrally extending outward from around the mat.

3. A mat seal device as claimed in claim 1 in which:

the mat includes a plurality of cable insertion holes arranged in a rectangular array;

a plurality of front-side recesses are formed in the front surface of the mat, the plurality of front-side recesses being disposed in disconnected arrays surrounding and adjacent respective ones of the plurality of cable insertion holes, and only a single recess is formed in the front surface between the respective ones of the plurality of cable insertion holes that are adjacent to each other.

4. A mat seal device as defined in claim 1 in which each front-side recess extends to a depth approximating that of the forward annular sealing rib.

5. A mat seal device as defined in claim 4 in which the plurality of front-side recesses are disposed in a generally symmetrical array equidistant from the cable insertion hole.

6. A mat seal device as defined in claim 5 in which four disconnected front-side recesses surround the cable insertion hole and in which:

two of the four disconnected front-side recesses are disposed in diametrically opposite positions above and below the cable insertion hole; and the remaining two disconnected front-side recesses are disposed in diametrically opposite positions on either side of the cable insertion hole.

7. A mat seal device as defined in claim 6 in which:

the mat includes a plurality of cable insertion holes arranged in a rectangular array;

a plurality of front-side recesses are formed in the front surface of the mat, the plurality of front-side recesses being disposed in disconnected arrays surrounding and adjacent respective ones of the plurality of cable insertion holes, and only a single recess is formed in the front surface between the respective ones of the plurality of cable insertion holes that are adjacent to each other.

8. A mat seal device for preventing water from entering an electrical connector through holes provided for cables to be inserted into the connector, the device comprising:

a mat of elastic material shaped to fit within and across a correspondingly-shaped opening in one end of an electrical connector housing and configured to prevent moisture from entering the housing through the opening;

an outer peripheral edge seal extending from the mat and configured to prevent moisture from passing between an outer periphery of the mat and a corresponding inner sealing surface of a connector housing;

a cable-sealing cable insertion hole extending through the mat and configured to receive insertion of a cable into a connector and to prevent moisture from passing between an inner periphery of the cable insertion hole and an outer surface of a cable received in that hole, the cable insertion hole including a first radially inwardly-extending annular sealing rib having an aperture smaller in diameter than a cable to be received in the hole so that the first annular sealing rib will be elastically enlarged when receiving the cable and will constrict around and seal against an outer surface of the cable; and a recess formed in a surface of the mat adjacent and spaced from the cable insertion hole and configured to relieve expansion of the adjacent annular sealing rib, wherein a plurality of front-side recesses are formed in a front surface of the mat and are disposed in an array surrounding and adjacent the cable insertion hole, wherein each front-side recess extends to a depth approximating that of the forward annular sealing rib, wherein the front-side recesses are disposed in a generally symmetrical array equidistant from the cable insertion hole, wherein four front-side recesses surround the cable insertion hole and in which: two of the four front-side recesses are disposed in diametrically opposite positions above and below the cable insertion hole; and the remaining two front-side recesses are disposed in diametrically opposite positions on either side of the cable insertion hole, and wherein the cable insertion hole includes a second inwardly-extending annular sealing rib having an aperture smaller in diameter than a cable to be received in the hole so that the second annular sealing rib will be elastically enlarged when receiving the cable and will constrict around and seal against an outer surface of the cable; and a plurality of back-side recesses are formed in a back surface of the mat opposite the front surface and disposed in an array surrounding and adjacent the cable insertion hole.

9. A mat seal device as defined in claim 8 in which each back-side recess extends to a depth approximating that of the second annular sealing rib.

10. A mat seal device as defined in claim 9 in which the back-side recesses are disposed in a generally symmetrical array equidistant from the cable insertion hole.

11. A mat seal device as defined in claim 10 in which four back-side recesses surround the cable insertion hole and two of the four back-side recesses are disposed in diametrically opposite positions above and below the cable insertion hole while the remaining two back-side recesses are disposed in diametrically opposite positions on either side of the cable insertion hole.

12. A mat seal device as defined in claim 11 in which:

the mat includes a plurality of cable insertion holes arranged in a rectangular array; and only a single recess is formed in the front surface between adjacent cable insertion holes.

13. A mat seal device as defined in claim 11 in which:

the mat includes a plurality of cable insertion holes arranged in a rectangular array; and only a single recess is formed in the back surface between adjacent cable insertion holes.

14. A connector assembly comprising:

an electrical connector housing;

a mat of elastic material shaped to fit within and across a correspondingly-shaped opening in one end of the electrical connector housing and configured to prevent moisture from entering the housing through the opening the mat including:

an outer peripheral edge seal configured to prevent moisture from passing between an outer periphery of the mat and a corresponding inner sealing surface of the electrical connector housing;

a cable-sealing cable insertion hole extending through the mat and configured to receive insertion of a cable into a connector and to prevent moisture from passing between an inner periphery of the cable insertion hole and an outer surface of a cable received in that hole;

a first radially inwardly-extending annular sealing rib extending radially inwardly from a circumferential wall of the hole and having an aperture smaller in diameter than a cable to be received in the hole so that the first annular sealing rib will be elastically enlarged when receiving the cable and will constrict around and seal against an outer surface of the cable; and a recess formed in a surface of the mat adjacent and spaced from the cable insertion hole and configured to relieve expansion of the adjacent annular sealing rib, wherein the recess is located to prevent intrusion of the electrical connector housing;

wherein:

the mat has a plurality of cable-sealing cable insertion holes extending trough the mat and configured to receive insertion of a cable into a connector and to prevent moisture from passing between an inner periphery of the cable insertion hole and an outer surface of a cable received in that hole, the plurality of cable insertion holes each include a first radially inwardly-extending annular sealing rib having an aperture smaller in diameter than a cable to be received in the hole so that the first annular sealing rib will be elastically enlarged when receiving the cable and will constrict around and seal against an outer surface of the cable; and a plurality of recesses are formed in the surface of the mat, the plurality of recesses being disposed in arrays of disconnected recesses surrounding and adjacent respective ones of the plurality of cable insertion holes to prevent intrusion of the electrical connector housing.

15. A mat seal device for preventing water from entering an electrical connector through holes provided for cables to be inserted into the connector, the device comprising:

a mat of elastic material shaped to fit within and across a correspondingly-shaped opening in one end of an electrical connector housing and configured to prevent moisture from entering the housing through the opening;

an outer peripheral edge seal extending from the mat and configured to prevent moisture from passing between an outer periphery of the mat and a corresponding inner sealing surface of a connector housing;

a plurality of cable-sealing cable insertion holes extending through the mat and configured to receive insertion of a cable into a connector and to prevent moisture from passing between an inner periphery of the cable insertion hole and an outer surface of a cable received in that hole, the plurality of cable insertion holes each including a first radially inwardly-extending annular sealing rib having an aperture smaller in diameter than a cable to be received in the hole so that the first annular sealing rib will be elastically enlarged when receiving the cable and will constrict around and seal against an outer surface of the cable;

a plurality of front-side recesses formed in a front surface of the mat, the plurality of front-side recesses being disposed in an array surrounding and adjacent respective ones of the plurality of cable insertion holes, the plurality of cable insertion hole each including a second inwardly-extending annular sealing rib having an aperture smaller in diameter than a cable to be received in the hole so that the second annular seating rib will be elastically enlarged when receiving the cable and will constrict around and seal against an outer surface of the cable; and a plurality of back-side recesses formed in a back surface of the mat opposite the front surface, the plurality of back-side recesses being disposed in an array surrounding and adjacent respective ones of the plurality of cable insertion holes.

16. The mat seal device of claim 15 wherein each front-side recess extends to a depth approximating that of the first annular sealing rib and each back-side recess extends to a depth approximating that of the second annular sealing rib.

17. The mat seal device of claim 16 wherein the front-side recesses and the back side recesses are disposed in a generally symmetrical array equidistant from the respective ones of the plurality of cable insertion holes.

18. The mat seal device of claim 17 wherein four front-side recesses surround the respective ones of the plurality of cable insertion holes and in which two of the four front-side recesses are disposed in diametrically opposite positions above and below the respective ones of the plurality of cable insertion hole; and the remaining two front-side recesses are disposed in diametrically opposite positions on either side of the respective ones of the plurality of cable insertion holes, and wherein four back-side recesses surround the respective ones of the plurality of cable insertion holes and in which two of the four back-side recesses are disposed in diametrically opposite positions above and below the respective ones of the plurality of cable insertion hole; and the remaining two back-side recesses are disposed in diametrically opposite positions on either side of the respective ones of the plurality of cable insertion holes.

* * * * *